US012622555B2

(12) United States Patent
Li et al.

(10) Patent No.: US 12,622,555 B2
(45) Date of Patent: May 12, 2026

(54) VACUUM GENERATOR AND NEGATIVE PRESSURE DUST SUCTION DEVICE HAVING SAME

(71) Applicant: CONTEMPORARY AMPEREX TECHNOLOGY CO., LIMITED, Ningde (CN)

(72) Inventors: Hongtao Li, Ningde (CN); Lei Song, Ningde (CN); Shengdong Chen, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 409 days.

(21) Appl. No.: 18/219,151

(22) Filed: Jul. 7, 2023

(65) Prior Publication Data

US 2024/0057833 A1 Feb. 22, 2024

Related U.S. Application Data

(63) Continuation of application No. PCT/CN2023/081650, filed on Mar. 15, 2023.

(30) Foreign Application Priority Data

Aug. 17, 2022 (CN) ..... 202210989186.2

(51) Int. Cl.
*A47L 9/24* (2006.01)
*A47L 5/12* (2006.01)
(Continued)

(52) U.S. Cl.
CPC ..... *A47L 9/248* (2013.01); *A47L 5/12* (2013.01); *A47L 9/0081* (2013.01); *A47L 9/242* (2013.01); *A47L 9/106* (2013.01)

(58) Field of Classification Search
CPC ..... A47L 9/248; A47L 5/12; A47L 9/0081; A47L 9/242; A47L 9/106
See application file for complete search history.

(56) References Cited

U.S. PATENT DOCUMENTS 1,521,729 A 1/1925 Suczek
4,846,617 A * 7/1989 Ehrhardt ..... F24D 10/006 417/151
(Continued)

FOREIGN PATENT DOCUMENTS

CN 102312869 A * 1/2012
CN 202348796 U 7/2012
(Continued)

OTHER PUBLICATIONS

CN-105757008-A—English Machine Translation (Year: 2016).*
(Continued)

*Primary Examiner* — Marc Carlson
(74) *Attorney, Agent, or Firm* — XSENSUS LLP

(57) ABSTRACT

A vacuum generator may comprise: a generator body provided with an air inlet, a contraction pipe section, an expansion pipe section, a negative pressure generation cavity, and an air outlet that may be sequentially communicated, where in a ventilation direction from the air inlet to the air outlet, a pipe diameter of the contraction pipe section may be gradually decreased, a pipe diameter of the expansion pipe section may be gradually increased, and the negative pressure generation cavity may be constructed to generate an inner cavity jet flow negative pressure when gas ejected from the expansion pipe section flows through the negative pressure generation cavity; wherein the generator body may be further provided with a negative pressure suction flow
(Continued)

channel, and the negative pressure suction flow channel may comprise a suction port section and a reduced-diameter flow channel section.

12 Claims, 3 Drawing Sheets

(51) Int. Cl.
*A47L 9/00* (2006.01)
*A47L 9/10* (2006.01)

(56) References Cited

U.S. PATENT DOCUMENTS

| | | | | | |
|---|---|---|---|---|---|
| 4,898,517 | A * | 2/1990 | Eriksen | F04F 5/20 417/151 |
| 5,167,046 | A * | 12/1992 | Benson | B05B 15/00 15/409 |
| 6,042,341 | A * | 3/2000 | Richter | F04F 5/20 417/409 |
| 7,354,029 | B1 * | 4/2008 | Rutstein | B01F 23/50 261/78.2 |
| 10,316,864 | B2 * | 6/2019 | Fletcher | F04F 5/20 |
| 10,422,351 | B2 * | 9/2019 | Fletcher | F04F 5/20 |
| 2009/0317691 | A1 | 12/2009 | Yamada et al. | |

FOREIGN PATENT DOCUMENTS

| | | | | | |
|---|---|---|---|---|---|
| CN | 102730445 | A | | 10/2012 | |
| CN | 203394893 | U | | 1/2014 | |
| CN | 103883568 | A | | 6/2014 | |
| CN | 105757008 | A | * | 7/2016 | F04F 5/46 |
| CN | 108317108 | A | | 7/2018 | |
| CN | 109798268 | A | | 5/2019 | |
| CN | 209557359 | U | | 10/2019 | |
| CN | 210541299 | U | | 5/2020 | |
| CN | 113144797 | A | | 7/2021 | |
| DE | 102017120521 | A1 | | 3/2019 | |
| EP | 3412920 | A1 | | 12/2018 | |
| GB | 1520245 | A | | 8/1978 | |
| JP | 2001-295800 | A | | 10/2001 | |

OTHER PUBLICATIONS

CN-102312869-A—English Machine Translation (Year: 2012).*
Notice of Grant issued on Sep. 16, 2023, in corresponding Chinese patent Application No. 202210989186.2, 6 pages.
Extended European Search Report issued Jun. 10, 2024 in European Patent Application No. 23740919.8.
Communication pursuant to Rule 71(3) EPC issued Feb. 26, 2025 in European Patent Application No. 23740919.8.
Written opinion dated Jul. 7, 2023 in WO#PCT/CN2023/081650, 16pp.

* cited by examiner

VACUUM GENERATOR AND NEGATIVE PRESSURE DUST SUCTION DEVICE HAVING SAME

CROSS-REFERENCE TO RELATED APPLICATIONS

The present application is a continuation of International Application No. PCT/CN2023/081650, filed Mar. 15, 2023, which claims priority to Chinese Patent Application No. 202210989186.2, filed on Aug. 17, 2022 and entitled "VACUUM GENERATOR AND NEGATIVE PRESSURE DUST SUCTION DEVICE HAVING SAME", the entire contents of each of which are incorporated herein by reference.

TECHNICAL FIELD

Embodiments of the present application relate to the technical field of negative pressure dust suction devices, and in particular, to a vacuum generator and a negative pressure dust suction device having the same.

BACKGROUND

In the prior art, the suction force of a negative pressure dust suction device is small, cannot achieve an effective dust removal effect in situations where dust has high adhesive force.

SUMMARY OF THE DISCLOSURE

In view of the above problems, embodiments of the present application provide a vacuum generator and a negative pressure dust suction device having the same. The vacuum generator provided in the present application is capable of providing negative pressure suction force to the vacuum generator through the fitting of the negative pressure generation cavity and the negative pressure suction flow channel.

In a first aspect of the present application, a vacuum generator is provided. The vacuum generator comprises: a generator body provided with an air inlet, a contraction pipe section, an expansion pipe section, a negative pressure generation cavity, and an air outlet that are sequentially communicated, where in a ventilation direction from the air inlet to the air outlet, a pipe diameter of the contraction pipe section is gradually decreased, a pipe diameter of the expansion pipe section is gradually increased, and the negative pressure generation cavity is constructed to generate an inner cavity jet flow negative pressure when gas ejected from the expansion pipe section flows through the negative pressure generation cavity; wherein the generator body is further provided with a negative pressure suction flow channel, the negative pressure suction flow channel comprises a suction port section and a reduced-diameter flow channel section, one end of the reduced-diameter flow channel section communicates with the negative pressure generation cavity, and the other end communicates with one end of the suction port section, the other end of the suction port section penetrates through a side wall of the generator body, and in an air intake direction of the reduced-diameter flow channel section, a cross-sectional area of the flow channel of the reduced-diameter flow channel section is gradually decreased.

Thus, the vacuum generator provides negative pressure suction force to the vacuum generator through the fitting of the negative pressure generation cavity and the negative pressure suction flow channel. Specifically, the negative pressure generation cavity is constructed to generate inner cavity jet flow negative pressure when gas ejected from the expansion pipe section flows through the negative pressure generation cavity, by means of the inner cavity jet flow negative pressure, the purpose of providing negative pressure suction force for the vacuum generator is achieved. Similarly, after the fluid passes through the reduced-diameter flow channel section of the negative pressure suction flow channel, the inner cavity jet flow negative pressure can also be generated in the negative pressure generation cavity, and by means of the negative pressure generated during suction of the negative pressure suction flow channel, the purpose of providing negative pressure suction force for the vacuum generator is further achieved, thereby improving suction and dust removal capacity.

In some embodiments, the reduced-diameter flow channel section is an annular cavity structure arranged around the periphery of the negative pressure generation cavity, an inner side of the annular cavity structure close to the negative pressure generation cavity is provided with a first communication port which is arranged around the periphery of the negative pressure generation cavity and communicates with the negative pressure generation cavity, and an outer side of the annular cavity structure away from the negative pressure generation cavity is provided with a second communication port communicating with the suction port section. Thus, the annular cavity structure is able to communicate with the negative pressure generation cavity from the periphery of the negative pressure generation cavity through the first communication port, allowing gas to be sucked into the negative pressure generation cavity.

In some embodiments, from one end of the negative pressure generation cavity communicating with the expansion pipe section to one end of the negative pressure generation cavity communicating with the air outlet, the cross-sectional area of the flow channel of the negative pressure generation cavity is gradually decreased. By setting the cross-sectional area of the flow channel at one end of the negative pressure generation cavity communicating with the expansion pipe section to a large size, the flow efficiency of fluid from the expansion pipe section to the negative pressure generation cavity can be improved.

In some embodiments, the cavity wall of the negative pressure generation cavity is a horn-shaped curved wall, and the horn-shaped curved wall is a curved structure enclosed by the motion trajectory of an arc-shaped generatrix when it moves around the central axis. The curved structure has less resistance to the fluid, which helps to improve the flow efficiency of the fluid at the curved structure.

In some embodiments, the horn-shaped curved wall protrudes into the cavity of the negative pressure generation cavity. By protruding into the cavity of the negative pressure generation cavity, the horn-shaped curved wall is capable of draining the fluid, so that the fluid can flow to the negative pressure generation cavity under a guidance and drainage effect of the horn-shaped curved wall. The horn-shaped curved wall provides the Coanda effect for the fluid flowing through the reduced-diameter flow channel section and into the negative pressure generation cavity, and guides the fluid to flow towards the gas outlet direction of the negative pressure generation cavity under the Coanda effect, thereby improving the flow efficiency of the fluid between the negative pressure suction flow channel and the negative pressure generation cavity, and improving the negative pressure effect of the negative pressure generation cavity.

In some embodiments, the reduced-diameter flow channel section is an annular cavity structure arranged around the periphery of the negative pressure generation cavity; wherein an inner side of the annular cavity structure close to the negative pressure generation cavity is provided with a first communication port which is arranged around the periphery of the negative pressure generation cavity and communicates with the negative pressure generation cavity, the first communication port being in communication with the negative pressure generation cavity; an outer side of the annular cavity structure away from the negative pressure generation cavity is provided with a second communication port communicating with the suction port section. During the process of flowing from the second communication port to the first communication port and flowing out of the first communication port and into the negative pressure generation cavity, the fluid undergoes a process of being compressed first and then released, the flow rate of the fluid is increased by the process.

In some embodiments, the first communication port communicates with one end of the negative pressure generation cavity close to the expansion pipe section, so that the reduced-diameter flow channel section fits with one end of the negative pressure generation cavity close to the expansion pipe section to form a channel structure in which the cross-sectional area of the flow channel is decreased first and then increased. After the fluid passes through the channel structure that is decreased first and then increased, a jet flow can also be generated, thereby improving the flow efficiency of the fluid between the reduced-diameter flow channel section and the negative pressure generation cavity.

In some embodiments, the arc radius of the arc-shaped generatrix is R, and the width dimension of the first communication port in the direction of the central axis of the reduced-diameter flow channel section is L, where L/R=0.1. Thus, on the basis of not affecting the flow efficiency of the fluid at the first communication port, the drainage and guidance effect of the arc-shaped generatrix of the horn-shaped curved wall on the fluid is improved, which makes a full use of the Coanda effect to improve the suction performance of the negative pressure suction flow channel.

In some embodiments, the inner wall of the first communication port is in smooth transition and connection with the inner wall of the negative pressure generation cavity. By means of arranging a smooth transition and connection between the inner wall of the first communication port and the inner wall of the negative pressure generation cavity, the flow smoothness and flow efficiency of fluid between the first communication port and the negative pressure generation cavity can be improved.

In some embodiments, from one end of the suction port section penetrating through the side wall of the generator body to one end of the suction port section communicating with the reduced-diameter flow channel section, the cross-sectional area of the flow channel of the suction port section is gradually decreased. Thus, by gradually compressing the fluid in the suction port section, and finally diffusing same in the negative pressure generation cavity, a high flow velocity is obtained during the compression and diffusion of the fluid, thereby improving the flow velocity of the fluid in the suction port section after flowing into the negative pressure generation cavity.

In some embodiments, the generator body is an assembled body composed of a plurality of individual parts detachably assembled. By configuring the vacuum generator as an assembled body, the individual parts can be separately processed, thereby reducing the difficulty in manufacturing the vacuum generator, so that the complex flow channels and structures in the vacuum generator can be accomplished by simple machining.

In some embodiments, the plurality of individual parts includes a first individual part, a second individual part, and a third individual part that are detachably connected in sequence; wherein the air inlet and the contraction pipe section are provided in the first individual part, the expansion pipe section is provided in the second individual part, the negative pressure generation cavity and the air outlet are provided in the third individual part, and the second individual part and the third individual part are assembled and fitted to form the negative pressure suction flow channel. In the vacuum generator formed by assembling a plurality of individual parts, the contraction pipe section, the expansion pipe section, the negative pressure generation cavity, and the negative pressure suction flow channel can be processed separately, so as to reduce difficulty in manufacturing the contraction pipe section, the expansion pipe section, the negative pressure generation cavity, and the negative pressure suction flow channel.

In a second aspect of the present application, a negative pressure dust suction device is provided, the negative pressure dust suction device comprises: a dust suction pipe; and an vacuum generator according to the first aspect of the present application, the negative pressure suction flow channel of the vacuum generator is configured for negative pressure dust suction, and the air inlet of the vacuum generator is configured to communicate with an air outlet of an air pump. Since the negative pressure dust suction device adopts the vacuum generator in the above embodiments, a large negative pressure for dust suction can be provided through the vacuum generator, thereby improving the working efficiency of the negative pressure dust suction device.

In some embodiments, the negative pressure dust suction device further comprises an exhaust pipe in communication with an air outlet of the vacuum generator; wherein the exhaust pipe is connected in series with a filter and/or a silencer. Thus, impurities such as dust in the exhaust pipe are absorbed by the filter, thereby reducing the phenomenon that the impurities such as dust in the exhaust pipe flow out of the negative pressure dust suction device and pollute the air, and the noise at the outlet of the exhaust pipe is absorbed by the silencer, thereby reducing the noise of the negative pressure dust suction device.

The above description is only a summary of the technical solutions of the present application. In order to be able to understand the technical means of the present application more clearly, the technical means can be implemented according to the content of the specification. Furthermore, to make the above and other objectives, features and advantages of the present application more comprehensible, specific implementations of the present application are exemplified below.

DESCRIPTION OF DRAWINGS

Various other advantages and benefits will become apparent to those of ordinary skill in the art upon reading the following detailed description of the preferred embodiments. The drawings are for the purpose of illustrating the preferred embodiments only and are not to be considered a limitation to the present application. In addition, the same components are denoted by the same reference numerals throughout the drawings. In the drawings.

Figure 1:
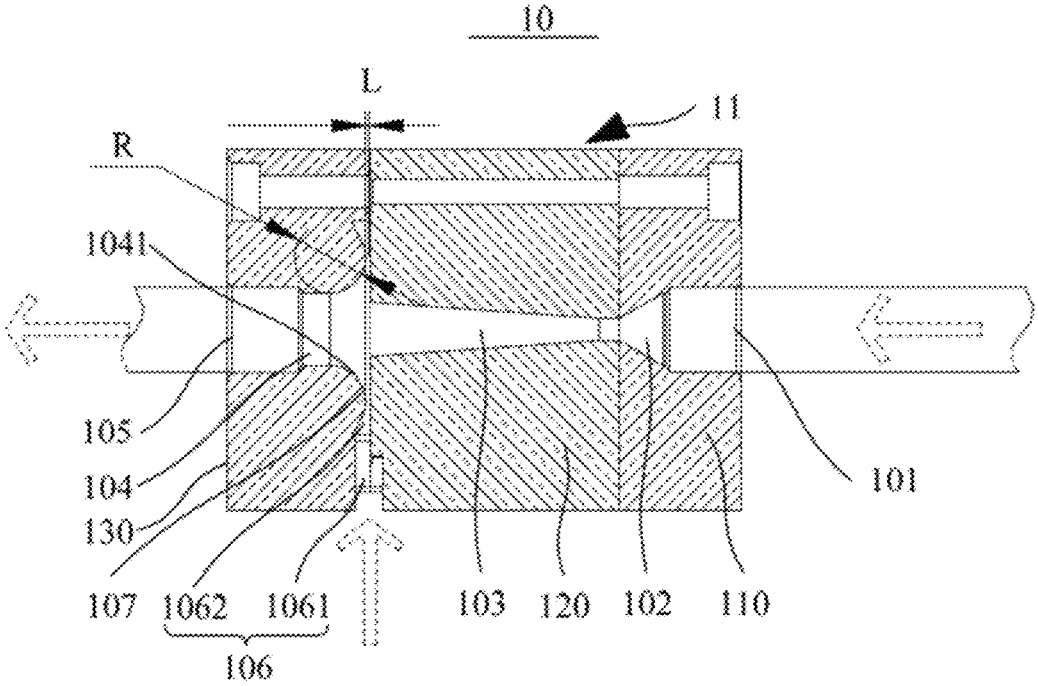
FIG. 1 is a schematic structural diagram of a vacuum generator according to some embodiments of the present application.

Some of the reference numerals in Detailed Description are as follows:

100 negative pressure dust suction device;

10 vacuum generator, 11 generator body, 101 air inlet, 102 contraction pipe section, 103 expansion pipe section, 104 negative pressure generation cavity, 1041 horn-shaped curved wall, 105 air outlet, 106 negative pressure suction flow channel, 1061 suction port section, 1062 reduced-diameter flow channel section, 107 annular cavity structure, 1071 first communication port, 1072 second communication port, 110 first individual part, 120 second individual part, 121 first notch, 130 third individual part, 131 second notch;

20 intake pipe;

30 exhaust pipe;

40 filter, 41 pipe connector;

50 silencer, 51 adapter.

DETAILED DESCRIPTION

Examples of the technical solutions of the present application will be described in detail below in conjunction with the drawings. The following embodiments are only used to more clearly illustrate the technical solution of the present application, and therefore are only used as examples and cannot be used to limit the scope of protection of the present application.

Unless otherwise defined, all technical and scientific terms used herein have the same meaning as commonly understood by those skilled in the art belonging to the technical field of the present application; the terms used herein are intended only for the purpose of describing specific examples and are not intended to limit the present application; the terms "including" and "having" and any variations thereof in the specification and the claims of the present application and in the description of drawings above are intended to cover non-exclusive inclusion.

In the description of the embodiments of the present application, the technical terms "first", "second", and the like are used only to distinguish between different objects, and are not to be understood as indicating or implying a relative importance or implicitly specifying the number, particular order, or primary and secondary relation of the technical features indicated. In the description of the embodiments of the present application, the meaning of "a plurality of" is two or more, unless otherwise explicitly and specifically defined.

Reference herein to "an embodiment" means that a particular feature, structure, or characteristic described in connection with the embodiment can be included in at least one embodiment of the present application. The appearance of this phrase in various places in the specification does not necessarily refer to the same embodiment, nor is it a separate or alternative embodiment that is mutually exclusive with other embodiments. It is explicitly and implicitly understood by those skilled in the art that the embodiments described herein may be combined with other embodiments.

In the description of the embodiments of the present application, the term "and/or" is only an association relationship for describing associated objects, indicating that there may be three relationships, for example A and/or B may represent three situations: A exists alone, both A and B exist, and B exists alone. In addition, the character "I" herein generally means that the associated objects before and after it are in an "or" relationship.

In the description of the embodiments of the present application, the term "a plurality of" refers to two or more (including two), and similarly, "multiple groups" refers to two or more (including two) groups, and "multiple sheets" refers to two or more (including two) sheets.

In the description of the embodiments of the present application, the orientation or position relationship indicated by the technical terms "center", "longitudinal", "transverse", "length", "width", "thickness", "upper", "lower", "front", "back", "left", "right", "vertical", "horizontal", "perpendicular", "parallel", "top", "bottom", "inner", "outer", "clockwise", "counterclockwise", "axial", "radial", "circumferential", etc. are based on the orientation or position relationship shown in the drawings and are intended to facilitate the description of the embodiments of the present application and simplify the description only, rather than indicating or implying that the device or element referred to must have a particular orientation or be constructed and operated in a particular orientation, and therefore are not to be interpreted as limitations on the embodiments of the present application.

In the description of the present application, unless otherwise expressly specified and limited, the technical terms "mounted", "connected with", "connected" and "fixed" should be broadly understood, for example, they may be a fixed connection or a detachable connection or be integrated; or may be a mechanical connection or an electrical connection; or may be a direct connection or an indirect connection through an intermediate medium, or may be a communication between the interior of two elements or the interaction of two elements. For those of ordinary skill in the art, the specific meanings of the above terms in the embodiments of the present application can be understood according to specific situations.

In the prior art, the suction force of the negative pressure dust suction device is small, cannot achieve an effective dust removal effect in situations where dust has high adhesive force. Specifically, the negative pressure dust suction device is provided with a vacuum generator, and the negative pressure suction force is provided for the negative pressure dust suction device through the negative pressure in the vacuum generator, so as to achieve the purpose of sucking dust into the negative pressure dust suction device, the negative pressure effect of the vacuum generator directly affects the dust suction effect of the negative pressure dust suction device.

In order to solve the technical problem that the negative pressure cleaning effect is poor due to the small suction force of the negative pressure suction device, the vacuum generator provided in some embodiments of the present application is able to provide negative pressure suction force to the vacuum generator through the fitting of the negative pressure generation cavity and the negative pressure suction flow channel, thereby improving the negative pressure suction force of the vacuum generator and the negative pressure dust suction device.

The vacuum generator disclosed in some embodiments of the present application may be used in a negative pressure dust suction device or other negative pressure apparatus, any negative pressure apparatus that requires negative pressure suction force belongs to the application scope of vacuum generator in some embodiments of the present application.

Figure 2:
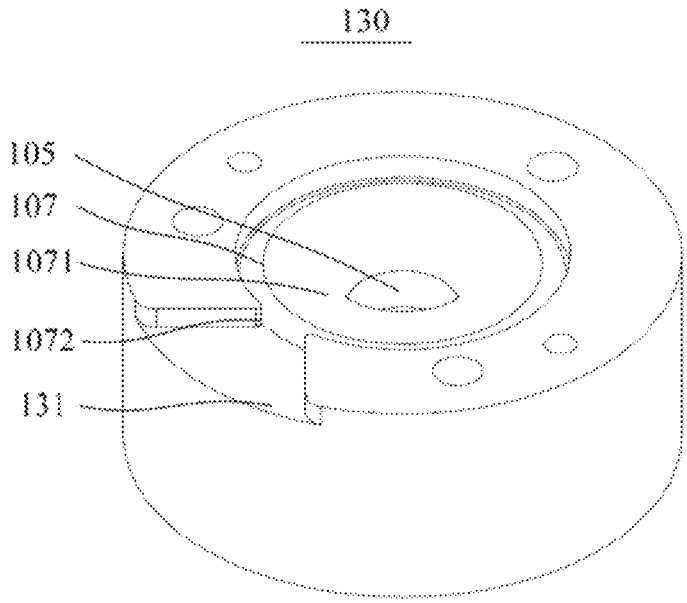
FIG. 2 is a schematic structural diagram of a negative pressure generation cavity of the vacuum generator shown in FIG. 1.
Figure 3:
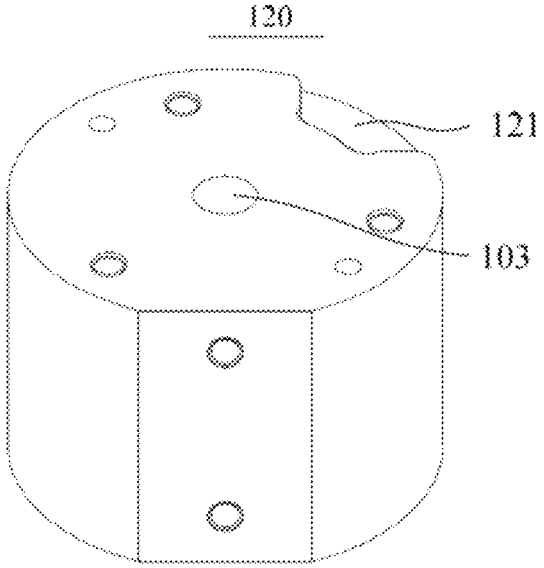
FIG. 3 is a schematic structural view of an expansion pipe section of the vacuum generator shown in FIG. 1.

Please refer to FIG. 1 to FIG. 3, where FIG. 1 is a schematic structural diagram of a vacuum generator according to some embodiments of the present application; FIG. 2 is a schematic structural diagram of a negative pressure generation cavity of the vacuum generator shown in FIG. 1; FIG. 3 is a schematic structural view of an expansion pipe section of the vacuum generator shown in FIG. 1;

As shown in FIG. 1 to FIG. 3, a first aspect of the present application provides a vacuum generator 10. The vacuum generator 10 includes a generator body 11, which is provided with an air inlet 101, a contraction pipe section 102, an expansion pipe section 103, a negative pressure generation cavity 104, and an air outlet 105 that are sequentially communicated. In a ventilation direction from the air inlet 101 to the air outlet 105, a pipe diameter of the contraction pipe section 102 is gradually decreased, a pipe diameter of the expansion pipe section 103 is gradually increased, and the negative pressure generation cavity 104 is constructed to generate an inner cavity jet flow negative pressure when gas ejected from the expansion pipe section 103 flows through the negative pressure generation cavity 104. wherein the generator body 11 is further provided with a negative pressure suction flow channel 106, the negative pressure suction flow channel 106 includes a suction port section 1061 and a reduced-diameter flow channel section 1062, one end of the reduced-diameter flow channel section 1062 communicates with the negative pressure generation cavity 104, and the other end communicates with one end of the suction port section 1061, the other end of the suction port section 1061 penetrates through a side wall of the generator body 11, and in an air intake direction of the reduced-diameter flow channel section 1062, a cross-sectional area of the flow channel of the reduced-diameter flow channel section 1062 is gradually decreased.

In this embodiment, the interior of the generator body 11 is formed with an airflow channel distributed along the length direction of the generator body 11, the air inlet 101 is disposed at the inlet end of the airflow channel, the air outlet 105 is disposed at the outlet end of the airflow channel, the contraction pipe section 102, expansion pipe section 103, and negative pressure generation cavity 104 are disposed at the middle portion of the airflow channel, and the negative pressure suction flow channel 106 penetrates through a side wall of the generator body 11 in a radial direction of the generator body 11 and communicates with the negative pressure generation cavity 104 and the atmosphere.

The vacuum generator 10 provided in some embodiments of the present application provides negative pressure suction force to the vacuum generator 10 through the fitting of the negative pressure generation cavity 104 and the negative pressure suction flow channel 106. Specifically, the negative pressure generation cavity 104 is constructed to generate an inner cavity jet flow negative pressure when gas ejected from the expansion pipe section 103 flows through the negative pressure generation cavity 104, and by means of the inner cavity jet flow negative pressure, the purpose of providing negative pressure suction force for the vacuum generator 10 is achieved. Similarly, after fluid passes through the reduced-diameter flow channel section 1062 of the negative pressure suction flow channel 106, the inner cavity jet flow negative pressure can also be generated in the negative pressure generation cavity 104, and by means of the negative pressure generated during suction of the negative pressure suction flow channel 106, the purpose of providing negative pressure suction force for the vacuum generator 10 is further achieved, thereby improving suction and dust removal capacity.

As shown in FIG. 1 to FIG. 3, in some embodiments, the reduced-diameter flow channel section 1062 is an annular cavity structure 107 arranged around the periphery of the negative pressure generation cavity 104, an inner side of the annular cavity structure 107 close to the negative pressure generation cavity 104 is provided with a first communication port 1071, which is disposed around the periphery of the negative pressure generation cavity 104 and communicates with the negative pressure generation cavity 104, and an outer side of the annular cavity structure 107 away from the negative pressure generation cavity 104 is provided with a second communication port 1072 communicating with the suction port section 1061.

In this embodiment, the annular cavity structure 107 is disposed on a radial periphery of the negative pressure generation cavity 104, and the cross-sectional shape of the annular cavity structure 107 may be arranged in an arc-shaped structure, a triangular structure, a rectangular structure, or an irregular shape. These structures all fall within the protection scope of some embodiments of the present application.

The annular cavity structure 107 provided in some embodiments of the present application communicates with the negative pressure generation cavity 104 from the periphery of the negative pressure generation cavity 104 through the first communication port 1071, so that gas is sucked into the negative pressure generation cavity 104, and the annular cavity structure 107 can further provide the Coanda effect for the fluid flowing through the reduced-diameter flow channel section 1062, and guide the fluid to flow in the direction of negative pressure generation cavity 104 under the Coanda effect, thereby improving the flow efficiency of the fluid between the negative pressure suction flow channel 106 and the negative pressure generation cavity 104, and improving the negative pressure effect of the negative pressure generation cavity 104.

As shown in FIG. 1 to FIG. 3, in some embodiments, from one end of the negative pressure generation cavity 104 communicating with the expansion pipe section 103 to one end of the negative pressure generation cavity 104 communicating with the air outlet 105, the cross-sectional area of the flow channel of the negative pressure generation cavity 104 is gradually decreased.

In this embodiment, the inner wall contour of the flow channel of the negative pressure generation cavity 104 may be arranged with an inclined surface, an arc surface, or a stepped surface along the flow direction of the fluid, so as to achieve the purpose of gradually reducing the cross-sectional area of the flow channel of the negative pressure generation cavity 104.

In the embodiment of the present application, by setting the cross-sectional area of the flow channel at one end of the negative pressure generation cavity 104 communicating with the expansion pipe section 103 to a large size, the flow efficiency of fluid from the expansion pipe section 103 to the negative pressure generation cavity 104 can be improved.

As shown in FIG. 1 to FIG. 3, in some embodiments, the cavity wall of the negative pressure generation cavity 104 is a horn-shaped curved wall 1041, and the horn-shaped curved wall 1041 is a curved structure enclosed by the motion trajectory of an arc-shaped generatrix when it moves around the central axis.

In this embodiment, the horn-shaped curved wall 1041 is disposed at the junction of the negative pressure generation cavity 104, the expansion pipe section 103 and the negative pressure suction flow channel 106, and the flare of the horn-shaped curved wall 1041 is in communication with the expansion pipe section 103, and a radially outer edge portion of the horn-shaped curved wall 1041 is in communication with the negative pressure suction flow channel 106.

Since the negative pressure generation cavity 104 is in linear communication with the expansion pipe section 103, the negative pressure generation cavity 104 does not need to provide drainage for the expansion pipe section 103, and only needs to reduce the flow resistance between the negative pressure generation cavity 104 and the expansion pipe section 103 through the flare of the horn-shaped curved wall 1041; since the negative pressure generation cavity 104 is communication with the negative pressure suction flow channel 106 at an angle, a radial outer edge portion of the horn-shaped curved wall 1041 of the negative pressure generation cavity 104 needs to provide guidance and drainage for the negative pressure suction flow channel 106, enables the fluid in the negative pressure suction flow channel 106 to smoothly flow to the negative pressure generation cavity 104 under the drainage of the radial outer edge portion of the horn-shaped curved wall 1041.

The horn-shaped curved wall 1041 provided in some embodiments of the present application is disposed at the junction of the negative pressure generation cavity 104, the expansion pipe section 103 and the negative pressure suction flow channel 106, so as to reduce a flow resistance of the fluid flowing from the expansion pipe section 103 to the negative pressure generation cavity 104, and reduce a flow resistance of the fluid flowing from the negative pressure suction flow channel 106 to the negative pressure generation cavity 104, thereby improving overall flow efficiency of the fluid inside the vacuum generator 10.

As shown in FIG. 1 to FIG. 3, in some embodiments, the horn-shaped curved wall 1041 protrudes into the cavity of the negative pressure generation cavity.

In this embodiment, since the negative pressure generation cavity 104 is distributed along the longitudinal direction of the generator body 11, while the negative pressure suction flow channel 106 is distributed along the radial direction of the generator body 11, the fluid turns during the process of flowing between the negative pressure suction flow channel 106 and the negative pressure generation cavity 104. In order to reduce the turning resistance of the fluid, the embodiment of the present application proposes that the horn-shaped curved wall 1041 protrudes into the cavity of the negative pressure generation cavity, thereby achieving the purpose of providing guidance and drainage for turning of the fluid, and reducing the flow resistance between the negative pressure suction flow channel 106 and the negative pressure generation cavity 104.

In some embodiments of the present application, the horn-shaped curved wall 1041 protrudes into the cavity of the negative pressure generation cavity to drain the fluid, so that the fluid can flow from the negative pressure suction flow channel 106 to the negative pressure generation cavity under the guidance and drainage effect of the horn-shaped curved wall 1041. Specifically, the horn-shaped curved wall 1041 provides the Coanda effect for the fluid flowing through the reduced-diameter flow channel section 1062 and into the negative pressure generation cavity 104, and guides the fluid to flow toward the outlet direction of the negative pressure generation cavity 104 under the Coanda effect, thereby improving the flow efficiency of the fluid between the negative pressure suction flow channel 106 and the negative pressure generation cavity 104, and improving the negative pressure effect of the negative pressure generation cavity 104.

As shown in FIG. 1 to FIG. 3, in some embodiments, the reduced-diameter flow channel section 1062 is an annular cavity structure 107 arranged around the periphery of the negative pressure generation cavity 104; wherein an inner side of the annular cavity structure 107 close to the negative pressure generation cavity 104 is provided with a first communication port 1071 which is arranged around the periphery of the negative pressure generation cavity 104 and communicates with the negative pressure generation cavity 104, the first communication port 1071 is in communication with the negative pressure generation cavity 104; and an outer side of the annular cavity structure 107 away from the negative pressure generation cavity 104 is provided with a second communication port 1072 communicating with the suction port section 1061.

In this embodiment, the reduced-diameter flow channel section 1062 is formed integrally with the horn-shaped curved wall 1041 in an arc-shaped structure, the horn-shaped curved wall 1041 protrudes into the cavity of the negative pressure generation cavity, extending to the negative pressure suction flow channel 106 and protruding into the cavity of the negative pressure suction flow channel 106.

In some embodiments of the present application, the integrated arc-shaped structure formed by the reduced-diameter flow channel section 1062 and the horn-shaped curved wall 1041 is capable of providing the Coanda effect to the fluid flowing through reduced-diameter flow channel section 1062, and guiding the fluid to flow in the direction of the negative pressure generation cavity 104 under the Coanda effect, thereby improving the flow efficiency of the fluid between the negative pressure suction flow channel 106 and the negative pressure generation cavity 104, and improving the negative pressure effect of the negative pressure generation cavity 104. In addition, during the process of flowing from the second communication port 1072 to the first communication port 1071 and flowing out of the first communication port 1071 into the negative pressure generation cavity 104, the fluid undergoes a process of being compressed first and then released, the flow rate of the fluid is increased by the process.

As shown in FIG. 1 to FIG. 3, in some embodiments, the first communication port 1071 communicates with one end of the negative pressure generation cavity 104 close to the expansion pipe section 103, so that the reduced-diameter flow channel section 1062 fits with one end of the negative pressure generation cavity 104 close to the expansion pipe section 103 to form a channel structure in which the cross-sectional area of the flow channel is decreased first and then increased.

In this embodiment, a cavity port is formed at one end of the negative pressure generation cavity 104 close to the expansion pipe section 103, an annular cavity structure 107 distributed around the circumference of the cavity port is formed by machining at the radial periphery of the cavity port, in this way, the first communication port 1071 between the annular cavity structure 107 and the negative pressure generation cavity 104 can be formed.

Specifically, the annular cavity structure 107 may be arranged as a complete annular structure distributed around the circumference of the negative pressure generation cavity 104, or may be arranged as a section of annular structure distributed around the circumference of the negative pressure generation cavity 104. The section of annular structure is arranged at a position corresponding to the second communication port 1072, so that fluid entering from the second communication port 1072 can flow into the negative pressure generation cavity 104 through the section of annular cavity structure 107.

The embodiment of the present application proposes that after the fluid passing through a channel structure that is first decreased and then increased, a jet flow can also be generated, thereby improving the flow efficiency of the fluid between the reduced-diameter flow channel section 1062 and the negative pressure generation cavity 104.

As shown in FIG. 1 to FIG. 3, in some embodiments, the arc radius of the arc-shaped generatrix is R, and the width dimension of the first communication port 1071 in the direction of the central axis of the reduced-diameter flow channel section 1062 is L, where L/R=0.1.

In this embodiment, if the size of the first communication port 1071 is too small, the flow of the fluid at the first communication port 1071 will be hindered, if the size of the first communication port 1071 is too large, the effect that the fluid at the first communication port 1071 forms a jet in the negative pressure generation cavity 104 is not achievable; and if the arc radius R of the arc-shaped generatrix is too small, the sharp arc-shaped protrusion will also hinder the flow of the fluid at the first communication port 1071, if the arc radius R of the arc-shaped generatrix is too large, the effect that the fluid at the first communication port 1071 forms the Coanda effect at the arc-shaped generatrix is not achievable. Therefore, in the embodiment of the present application, by comprehensively considering the size of the first communication port 1071 and the arc radius R of the arc-shaped generatrix, a size relationship between the size of the first communication port 1071 and the arc radius R of the arc-shaped generatrix is proposed, so as to improve flow effect of the fluid flowing toward the negative pressure generation cavity 104 through the arc-shaped generatrix without affecting the flow efficiency of the fluid at the first communication port 1071.

Specifically, L/R=0.1 is merely a preferred embodiment of the present application, it is not limited to the ratio of L to R. The ratio of L to R may be flexibly set according to the size of the first communication port 1071, the size of the negative pressure generation cavity 104, the characteristics of the fluid, and the temperature of the fluid. Details are not described herein by way of example.

The embodiment of the present application proposes that, on the basis of not affecting the flow efficiency of the fluid at the first communication port 1071, the drainage and guidance effect of the arc-shaped generatrix of the horn-shaped curved wall 1041 on the fluid is improved, which makes a full use of the Coanda effect to improve the suction performance of the negative pressure suction flow channel 106.

As shown in FIG. 1 to FIG. 3, in some embodiments, the inner wall of the first communication port 1071 is in smooth transition and connection with the inner wall of the negative pressure generation cavity.

In this embodiment, by means of the smooth transition and connection between the inner wall of the first communication port 1071 and the inner wall of the negative pressure generation cavity, the flow efficiency of the fluid between the negative pressure suction flow channel 106 and the negative pressure generation cavity can be improved, thereby increasing the flow rate of the fluid in the negative pressure suction flow channel 106 and the negative pressure generation cavity, and improving the negative pressure effect of the negative pressure generation cavity.

In some embodiments of the present application, by means of arranging a smooth transition and connection between the inner wall of the first communication port 1071 and the inner wall of the negative pressure generation cavity, the flow smoothness and flow efficiency of fluid between the first communication port 1071 and the negative pressure generation cavity can be improved.

As shown in FIG. 1 to FIG. 3, in some embodiments, from one end of the suction port section 1061 penetrating through the side wall of the generator body 11 to one end of the suction port section 1061 communicating with the reduced-diameter flow channel section 1062, the cross-sectional area of the flow channel of the suction port section 1061 is gradually decreased.

In this embodiment, the inner wall contour of the flow channel of the suction port section 1061 may be arranged as an inclined surface, an arc surface, or a stepped surface along the flow direction of the fluid, so as to achieve the purpose of gradually reducing the cross-sectional area of the flow channel of the suction port section 1061.

In the embodiment of the present application, by gradually compressing the fluid in the suction port section 1061, and finally diffusing same in the negative pressure generation cavity 104, a high flow velocity is obtained during the compression and diffusion of the fluid, thereby improving the flow velocity of the fluid in the suction port section 1061 after flowing into the negative pressure generation cavity.

As shown in FIG. 1 to FIG. 3, in some embodiments, the generator body 11 is an assembled body composed of a plurality of individual parts detachably assembled.

In this embodiment, the plurality of individual parts are arranged to be assembled in sequence along the length direction of the generator body 11, the plurality of individual parts may be arranged as a hollow columnar structure, a plurality of channels or cavities are formed in the plurality of individual parts, and after the plurality of individual parts are assembled in sequence along the length direction of the generator body 11, the plurality of channels or cavities in the plurality of individual parts are communicated in sequence, and then the plurality of individual parts are connected together by fasteners.

In the embodiment of the present application, by configuring the vacuum generator 10 as an assembled body, the individual parts can be separately processed, thereby reducing the difficulty in manufacturing the vacuum generator 10, so that the complex flow channels and structures in the vacuum generator 10 can be accomplished by simple machining.

In some embodiments, the plurality of individual parts comprises a first individual part 110, a second individual part 120, and a third individual part 130 that are detachably connected in sequence; wherein the air inlet 101 and the contraction pipe section 102 are provided on the first individual part 110, the expansion pipe section 103 is provided on the second individual part 120, the negative pressure generation cavity 104 and the air outlet 105 are provided on the third individual part 130, and the second individual part 120 and the third individual part 130 are assembled and fitted to form the negative pressure suction flow channel 106.

In this embodiment, the contraction pipe section 102 is arranged as a tapered channel extending inwardly from the air inlet 101 and having a gradually reduced inner diameter, and the expansion pipe section 103 is arranged as a tapered channel extending inwardly from the air outlet 105 and having a gradually reduced inner diameter. That is, both the contraction pipe section 102 and the expansion pipe section 103 are arranged to have a gradually reduced diameter from outside to inside. In addition, the contraction pipe section 102 and the expansion pipe section 103 are connected through a narrow channel. If the first individual part 110 and the second individual part 120 are arranged as an integrated structure, the depth and precision of the bore will be increased, thereby increasing manufacturing difficulty of the contraction pipe section 102 and the expansion pipe section 103. Therefore, the embodiment of the present application proposes that the first individual part 110 and the second individual part 120 are arranged as separate structures so as to reduce the depth and precision of the bore, thereby reducing manufacturing difficulty of the contraction pipe section 102 and the expansion pipe section 103.

Specifically, a first end portion of the second individual part 120 fitting with the third individual part 130 is formed with a first notch 121, a second end portion of the third individual part 130 fitting with the second individual part 120 is formed with a second notch 131, and a gap between the second notch 131 and the first notch 121 forms the suction port section 1061 of the negative pressure suction flow channel 106. The second notch 131 and the first notch 121 are both arranged as fan-shaped notches, and the angle range of the second notch 131 and the first notch 121 is determined according to the size of the expansion pipe section 103 and the size of the negative pressure generation cavity 104. The specific value is not limited herein.

The embodiment of the present application proposes that in the vacuum generator 10 formed by assembling a plurality of individual parts, the contraction pipe section 102, the expansion pipe section 103, the negative pressure generation cavity 104, and the negative pressure suction flow channel 106 can be processed separately, so as to reduce difficulty in manufacturing the contraction pipe section 102, the expansion pipe section 103, the negative pressure generation cavity 104, and the negative pressure suction flow channel 106.

In some embodiments, the inner walls of the contraction pipe section 102, the expansion pipe section 103, the negative pressure generation cavity 104, and the negative pressure suction flow channel 106 are all configured as polished surfaces, so that flow smoothness of the fluid in the vacuum generator 10 can be improved, thereby improving the negative pressure suction force of the vacuum generator 10.

The air inlet 101, the contraction pipe section 102, the expansion pipe section 103, the negative pressure generation cavity 104, and the air outlet 105 form a Laval nozzle structure. The front half of the Laval nozzle contracts inward from large to small to a narrow throat, and then the narrow throat expands outward from small to large to the outlet of the rear half. The fluid flows into the front half of the Laval nozzle under high pressure, after passing through the narrow throat, the fluid is accelerated and escapes from the rear half. This architecture allows the speed of the fluid to change according to the cross-sectional area of the nozzle, it is possible to accelerate the fluid from subsonic speed to sonic speed, and eventually to supersonic speed.

Specifically, the fluid flowing to the vacuum generator 10 through the air inlet 101 is compressed first through the contraction pipe section 102 of the Laval nozzle structure, and then expanded through the expansion pipe section 103 of the Laval nozzle structure. At a position where the gas reaches a maximum speed, a breakthrough is formed in the passage between the contraction pipe section 102 and the expansion pipe section 103 and the fluid is ejected to the expansion pipe section 103. The fluid ejected to the expansion pipe section 103 drives the fluid in the negative pressure generation cavity 104 to flow out rapidly from the air outlet 105, so that a negative pressure is formed in the negative pressure generation cavity 104.

Figure 4:
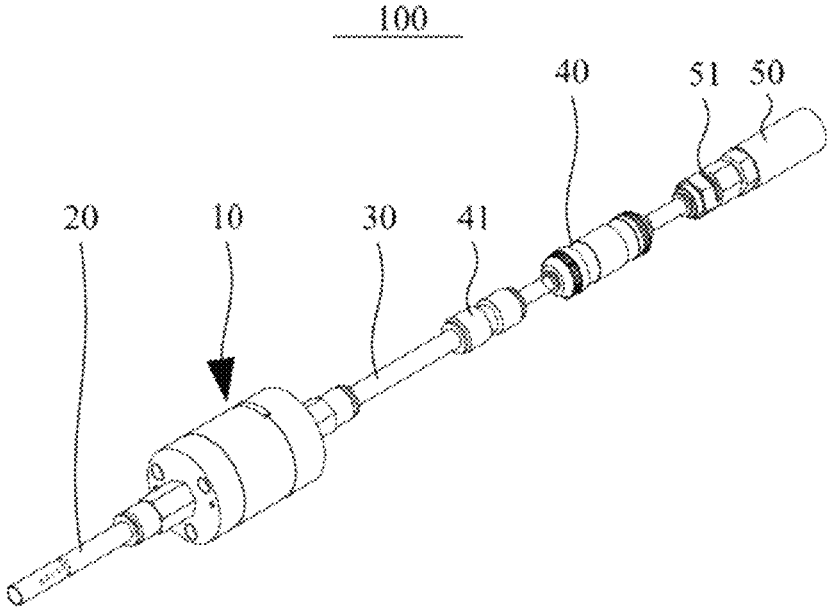
FIG. 4 is a schematic structural diagram of a negative pressure dust suction device according to some embodiments of the present application.

As shown in FIG. 4, a second aspect of the present application provides a negative pressure dust suction device 100. The negative pressure dust suction device 100 comprises a dust suction pipe and a vacuum generator 10 according to the first aspect of the present application. A negative pressure suction flow channel 106 of the vacuum generator 10 is configured for negative pressure dust suction, and an air inlet 101 of the vacuum generator 10 is configured to communicate with an air outlet 105 of an air pump.

In this embodiment, the air inlet 101 is further provided with an intake pipe 20, the intake pipe is further provided with a control valve, and the on-off and suction force of the intake pipe 20 are controlled by the control valve so as to improve the adaptability of the negative pressure dust suction device 100 to various environments.

Since the negative pressure dust suction device 100 provided in some embodiments of the present application adopts the vacuum generator 10 of some embodiments of the present application, it is capable of providing large dust suction negative pressure through the vacuum generator 10, thereby improving working efficiency of the negative pressure dust suction apparatus 100.

In some embodiments, the negative pressure dust suction device 100 further includes an exhaust pipe 30 in communication with the air outlet 105 of the vacuum generator 10; wherein the exhaust pipe 30 is connected in series with a filter 40 and/or a silencer 50.

In this embodiment, the filter 40 may be configured as a screen filter 40 or a honeycomb filter 40, and the filter 40 is detachably mounted to the exhaust pipe 30 through a pipe connector 41, and the silencer 50 is detachably mounted to the exhaust pipe 30 through an adapter 51, and is located at the outlet of an end portion of the exhaust pipe 30, used to eliminate noise at the outlet of the exhaust pipe 30.

In the embodiment of the present application, impurities such as dust in the exhaust pipe 30 are absorbed by the filter 40, so as to reduce the phenomenon that the impurities such as dust in the exhaust pipe 30 flow out of the negative pressure dust suction device 100 and pollute the air, and the noise at the outlet of the exhaust pipe 30 is absorbed by the silencer 50, so as to reduce the noise of the negative pressure dust suction device 100.

The working process of the negative pressure dust suction device 100 according to some embodiments of the present application is described below by using a specific embodiment.

When the negative pressure dust suction device 100 works, the fluid flowing to the vacuum generator 10 through the air inlet 101 is compressed first through the contraction pipe section 102 of the Laval nozzle structure, and then expanded through the expansion pipe section 103 of the Laval nozzle structure. At a position where the gas reaches a maximum speed, a breakthrough is formed in the passage between the contraction pipe section 102 and the expansion pipe section 103 and the fluid is ejected to the negative pressure generation cavity 104, and the fluid ejected to the negative pressure generation cavity 104 drives the fluid in the negative pressure generation cavity 104 to flow out rapidly from the air outlet 105; the external air enters the negative pressure generation cavity 104 of the vacuum generator 10 from the negative pressure suction flow channel 106 of the vacuum generator 10, and the fluid in the negative pressure suction flow channel 106 drives the fluid in the negative pressure generation cavity 104 to discharge from the air outlet 105.

Based on the working principle of the Laval nozzle, the negative pressure dust suction device 100 forms a negative pressure at the air inlet 101, the maximum jet flow velocity at the air outlet 105 can reach 650 m/s, the maximum flow drainage velocity of the negative pressure suction flow channel 106 can reach 130 m/s, the negative pressure at the air inlet 101 can reach 0.8 MPa, and the wind velocity at the air inlet 101 can reach 130 m/s, which is superior to the existing dust suction device (the negative pressure wind velocity of the existing dust suction device is less than m/s).

Finally, it should be noted that the above embodiments are merely used for illustrating rather than limiting the technical solutions of the present application. Although the present application has been described in detail with reference to the above various embodiments, those of ordinary skill in the art should understood that the technical solutions specified in the above various embodiments can still be modified, or some or all of the technical features therein can be equivalently substituted; and such modifications or substitutions do not make the essence of the corresponding technical solutions depart from the scope of the technical solutions of the various embodiments of the present application, and shall fall within the scope of the claims of the specification of the present application. In particular, the technical features mentioned in the various examples can be combined in any manner as long as there is no structural conflict. The present application is not limited to the specific embodiments disclosed herein, but rather includes all technical solutions falling within the scope of the claims.

The invention claimed is:

1. A vacuum generator, comprising:

a generator body provided with an air inlet, a contraction pipe section, an expansion pipe section, a negative pressure generation cavity, and an air outlet that are sequentially communicated, wherein in a ventilation direction from the air inlet to the air outlet, a pipe diameter of the contraction pipe section is gradually decreased, a pipe diameter of the expansion pipe section is gradually increased, and the negative pressure generation cavity is constructed to generate an inner cavity jet flow negative pressure when gas ejected from the expansion pipe section flows through the negative pressure generation cavity;

wherein the generator body is further provided with a negative pressure suction flow channel, the negative pressure suction flow channel comprises a suction port section and a reduced-diameter flow channel section, one end of the reduced-diameter flow channel section communicates directly with the negative pressure generation cavity, and the other end communicates with one end of the suction port section, the other end of the suction port section penetrates through a side wall of the generator body, and in an air intake direction of the reduced-diameter flow channel section, a cross-sectional area of the flow channel of the reduced-diameter flow channel section is gradually decreased;

from one end of the negative pressure generation cavity communicating with the expansion pipe section to one end of the negative pressure generation cavity communicating with the air outlet, a cross-sectional area of the flow channel of the negative pressure generation cavity is gradually decreased; and a cavity wall of the negative pressure generation cavity is a horn-shaped curved wall, and the horn-shaped curved wall is a curved structure enclosed by the motion trajectory of an arc-shaped generatrix when it moves around the central axis.

2. The vacuum generator according to claim 1, wherein the reduced-diameter flow channel section is an annular cavity structure arranged around the periphery of the negative pressure generation cavity, an inner side of the annular cavity structure close to the negative pressure generation cavity is provided with a first communication port which is arranged around the periphery of the negative pressure generation cavity and communicates with the negative pressure generation cavity, and an outer side of the annular cavity structure away from the negative pressure generation cavity is provided with a second communication port communicating with the suction port section.

3. The vacuum generator according to claim 1, wherein the horn-shaped curved wall protrudes into the cavity of the negative pressure generation cavity.

4. The vacuum generator according to claim 1, wherein the reduced-diameter flow channel section is an annular cavity structure arranged around the periphery of the negative pressure generation cavity;

wherein an inner side of the annular cavity structure close to the negative pressure generation cavity is provided with a first communication port which is arranged around the periphery of the negative pressure generation cavity and communicates with the negative pressure generation cavity, the first communication port being in communication with the negative pressure generation cavity;

an outer side of the annular cavity structure away from the negative pressure generation cavity is provided with a second communication port communicating with the suction port section.

5. The vacuum generator according to claim 4, wherein the first communication port communicates with one end of the negative pressure generation cavity close to the expansion pipe section, so that the reduced-diameter flow channel section fits with one end of the negative pressure generation cavity close to the expansion pipe section to form a channel structure in which the cross-sectional area of the flow channel is decreased first and then increased.

6. The vacuum generator according to claim 5, wherein the arc radius of the arc-shaped generatrix is R, and a width dimension of the first communication port in the direction of the central axis of the reduced-diameter flow channel section is L, where L/R=0.1.

7. The vacuum generator according to claim 5, wherein the inner wall of the first communication port is in smooth transition and connection with the inner wall of the negative pressure generation cavity.

8. The vacuum generator according to claim 1, wherein from one end of the suction port section penetrating through the side wall of the generator body to one end of the suction port section communicating with the reduced-diameter flow channel section, the cross-sectional area of the flow channel of the suction port section is gradually decreased.

9. The vacuum generator according to claim 1, wherein the generator body is an assembled body composed of a plurality of individual parts detachably assembled.

10. The vacuum generator according to claim 9, wherein the plurality of individual parts comprises a first individual part, a second individual part, and a third individual part that are detachably connected in sequence;

wherein the air inlet and the contraction pipe section are provided in the first individual part, the expansion pipe section is provided in the second individual part, the negative pressure generation cavity and the air outlet are provided in the third individual part, and the second individual part and the third individual part are assembled and fitted to form the negative pressure suction flow channel.

11. A negative pressure dust suction device, wherein the negative pressure dust suction device comprises the vacuum generator according to claim 1, the negative pressure suction flow channel of the vacuum generator is configured for negative pressure dust suction, and the air inlet of the vacuum generator is configured to communicate with an air outlet of an air pump.

12. The negative pressure dust suction device according to claim 11, wherein the negative pressure dust suction device further comprises an exhaust pipe in communication with the air outlet of the vacuum generator;

wherein the exhaust pipe is connected in series with a filter and/or a silencer.

* * * * *